US005701393A

United States Patent [19]

Smith, III et al.

[11] Patent Number: 5,701,393

[45] Date of Patent: Dec. 23, 1997

[54] SYSTEM AND METHOD FOR REAL TIME SINUSOIDAL SIGNAL GENERATION USING WAVEGUIDE RESONANCE OSCILLATORS

[75] Inventors: Julius O. Smith, III; Perry R. Cook, both of Palo Alto, Calif.

[73] Assignee: The Board of Trustees of the Leland Stanford Junior University, Stanford, Calif.

[21] Appl. No.: 267,175

[22] Filed: Jun. 28, 1994

Related U.S. Application Data

[63] Continuation of Ser. No. 878,953, May 5, 1992, abandoned.

[51] Int. Cl.[6] ..... G10H 7/12; G10K 15/02

[52] U.S. Cl. ..... 395/2.67; 395/2.7; 84/600; 327/129

[58] Field of Search ..... 395/2.09, 2.67, 395/2.7; 84/600; 327/105, 129

[56] References Cited

U.S. PATENT DOCUMENTS

| | | | |
|---|---|---|---|
| 4,027,100 | 5/1977 | Ishiguro | 178/69.1 |
| 4,192,008 | 3/1980 | Mandeville | 364/724 |
| 5,198,779 | 3/1993 | Bruton | 328/14 |
| 5,212,334 | 5/1993 | Smith, III | 84/622 |

OTHER PUBLICATIONS

Parsons, Thomas R., *Voice and Speech Processing*, 1986, pp. 106–114, 276–281.

*Primary Examiner*—Allen R. MacDonald
*Assistant Examiner*—Talivaldis Ivars Smits
*Attorney, Agent, or Firm*—Gary S. Williams; Flehr Hohbach Test Albritton & Herbert LLP

[57] ABSTRACT

Sinusoidal waveforms are synthesized using one or more waveguide resonance oscillators. The waveguide resonance oscillator has two digital delay elements coupled to a digital waveguide junction. Each digital delay element receives a signal on its respective input node and outputs the received signal on its respective output node after a delay of one sample period. In the preferred embodiment, the waveguide junction has three digital signal adders and one signal multiplier interconnected so as to compute, once each sample period, a new input value for each digital delay element as a function of the two signals output by the digital delay elements. The multiplier coefficient used by the waveguide junction's multiplier determines the generated waveform's frequency of oscillation. The two output signals from the waveguide junction are sinusoidal waveforms that are 90 degrees out of phase with each other. When the first multiplier's coefficient value is timing varying, the waveguide resonance oscillator generates a sinusoidal waveform of time varying frequency and a second multiplier is used in the waveguide junction to maintain the sinusoidal waveform at a substantially constant amplitude. By using a first waveguide resonance oscillator to control the multiplier coefficient of a second waveguide resonance oscillator, frequency modulated waveforms are generated by the second waveguide resonance oscillator.

12 Claims, 6 Drawing Sheets

SYSTEM AND METHOD FOR REAL TIME SINUSOIDAL SIGNAL GENERATION USING WAVEGUIDE RESONANCE OSCILLATORS

This is a continuation of application Ser. No. 07/878,953 filed May 5, 1992, now abandoned.

The present invention relates generally to generating sinusoidal signals and frequency modulated sinusoidal signals such as is found in musical synthesizers, and particularly to a computationally efficient system and method of using waveguide oscillators to compute sinusoidal waveforms.

BACKGROUND OF THE INVENTION

The use of digital waveguide networks for digital signal processing and musical synthesis is disclosed in U.S. Pat. No. 4,984,276, which teaches the use of digital processors having digital waveguide networks for digital reverberation and for synthesis of musical sounds such as those associated with reed and string instruments. The waveguide oscillators (also herein called resonance oscillators or waveguide resonance oscillators) of the present invention are not "digital waveguides" as defined in U.S. Pat. No. 4,984,276, but rather are a combination of the elements of two "digital waveguides" and one "signal scattering junction," using the terminology of U.S. Pat. No. 4,984,276.

A patent that addresses the use of digital waveguide networks for speech synthesis is U.S. Pat. No. 5,528,726 on Jun. 18, 1996.

Referring to FIG. 1, most prior art musical sound synthesizers 50 implemented using digital signal processing techniques, excluding the waveguide synthesizers of U.S. Pat. No. 4,984,276, have a first mechanism 52 (which may be implemented either in hardware or hardware and software) for computing a phase value $\phi(t)$, plus a sine-wave table 54 and an interpolator 56 for converting the phase value into an acoustic signal. The phase value computation mechanism 50 may use amplitude modulation, frequency modulation, or any other such technique. The SIN( ) table 54 is typically accessed twice to look-up the two entries closest to the current phase value, and the interpolator 56 computes an interpolated signal value using either linear interpolation or a higher order interpolation technique, depending on the amount of computational resources available and the amount of signal distortion that is acceptable. The output of the interpolator 56 is then multiplied by an amplitude value (using multiplier 58) to generate a digital output signal. Finally, a digital-to-analog converter 60 converts the digital signal to an analog electrical signal, and a audio speaker 62 converts the analog electrical signal into an acoustic signal.

Many prior art musical synthesizers simulate the sounds of various instruments using additive synthesis, which consists of summing together sinusoidal harmonics of appropriate amplitude and frequency. Thus, multiple parallel copies of the synthesizer elements 52–58 of FIG. 1 are provided in a typical music synthesizer so that complex sounds can be constructed using additive synthesis.

Since most acoustic signal synthesizers are implemented using either general purpose computers or digital data processors, or special purpose digital signal processors, computational efficiency is always a concern. The less computation required to synthesize each "voice", the more voices that can be generated using a given set of computational hardware. Furthermore, multiplication operations are generally considered to be more expensive than addition operations. In general purpose computers, multiplication usually takes longer than addition. When using digital signal processors, while multiplication can be performed in the same amount of time (e.g., one CPU clock cycle) as an addition, multiplier circuits consume considerably more space than adders, and therefore having multiple parallel multiplier circuits for vector data processing is much more expensive than having a similar number of parallel adders.

Another consideration that affects the cost of implementing any given acoustic signal synthesizer concerns the amount of dedicated high-speed memory (i.e., single cycle access time memory) required for each voice. In dedicated or customized digital signal processors (DSPs), such high speed memory is typically used for storage of control parameters, state variables and the look-up sine-wave table. Depending on the implementation, it may or may not be possible to have several voices share one sine-wave table. In any case, the selection of the sine-wave table size is based on both memory size and distortion considerations. Aliasing occurs if the highest frequency harmonic to be generated is not sampled at a rate which is above the Nyquist frequency (at least twice the frequency of the harmonic). This is determined by the wavetable length, sampling frequency, and playback frequency. Suffice it to say, that storage of a sufficiently accurate sine-wave table is generally expensive.

The object of the present invention is to provide a real time signal synthesizer that is computationally efficient. A related goal of the present invention is to provide an acoustic signal synthesizer that generates sinusoidal waveforms without having to access a sine-wave table to convert computed phase values into output waveforms.

SUMMARY OF THE INVENTION

In summary, acoustic frequency sinusoidal waveforms are synthesized using one or more waveguide resonance oscillators. Each waveguide resonance oscillator has two digital delay elements coupled to a digital waveguide junction. Each digital delay element receives a signal on its respective input node and outputs the received signal on its respective output node after a delay of one sample period. The waveguide junction, in the most efficient embodiment for VLSI implementation, has three digital signal adders and one signal multiplier interconnected so as to compute, once each sample period, a new input value for each digital delay element as a function of the two signals output by the digital delay elements. The multiplier coefficient used by the waveguide junction's multiplier determines the generated waveform's frequency of oscillation. The two output signals from the waveguide junction are sinusoidal waveforms that are 90 degrees out of phase with each other.

When the waveguide junction's multiplier coefficient value is timing varying, the waveguide resonance oscillator generates a sinusoidal waveform of time varying frequency and a second multiplier is used in the waveguide junction to maintain the sinusoidal waveform at a substantially constant amplitude. By using a first waveguide resonance oscillator to control the multiplier coefficient of a second waveguide resonance oscillator, frequency modulated waveforms are generated by the second waveguide resonance oscillator.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
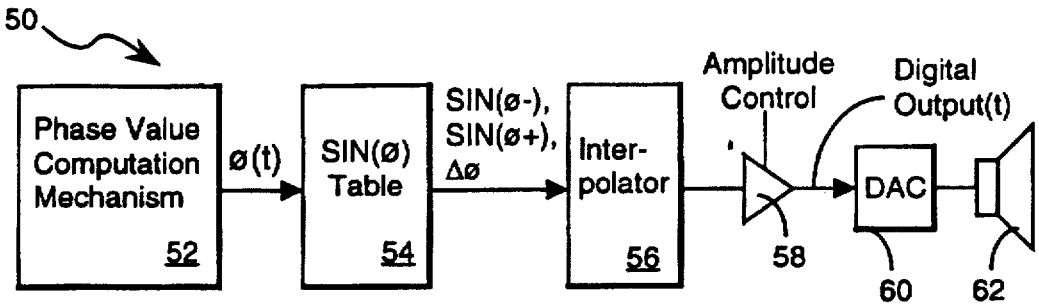
FIGURE 1 PRIOR ART
FIG. 1 is a block diagram of a prior art synthesizer for a single sinusoidal signal.
Figure 2:
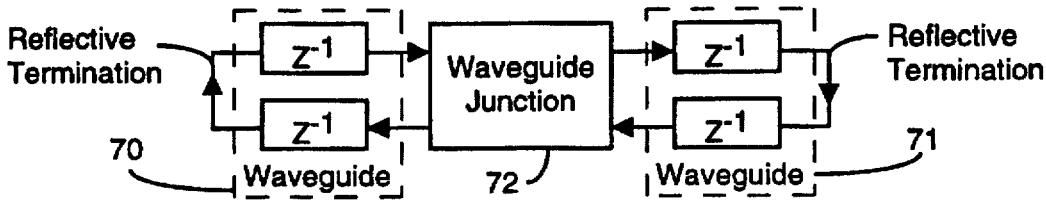
FIG. 2 is a conceptual diagram of a waveguide resonance oscillator in accordance with the present invention.

Referring to FIG. 2, in concept, the basic waveguide resonance oscillator of the present invention comprises two reflectively terminated digital waveguides 70, 71 interconnected by a waveguide junction 72. Because of the reflective terminations, and the lack of any other delay elements in the oscillator, each waveguide can be replaced by a single delay element without changing the operation of the oscillator (except for its time base).

Figure 3:
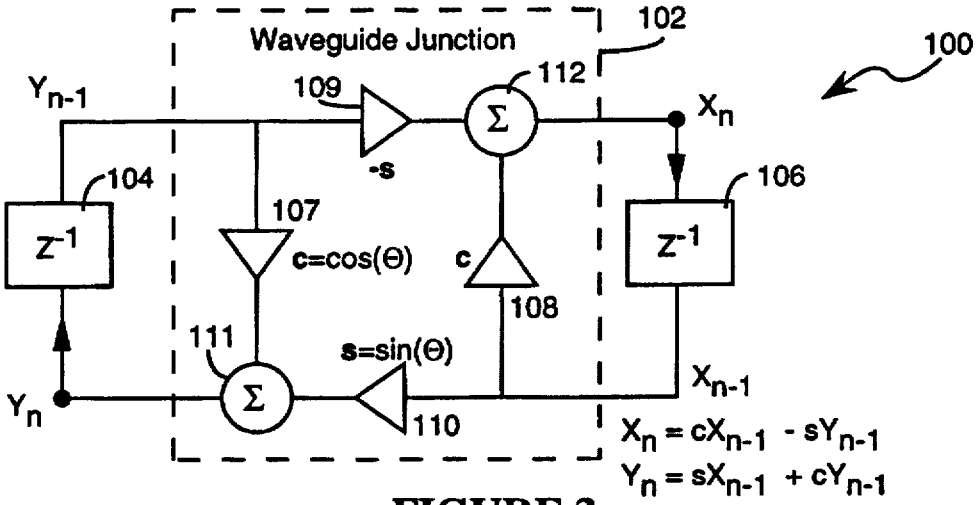
FIG. 3 is a block diagram of the basic model of a waveguide resonance oscillator in accordance with the present invention.

FIG. 3 shows the elements of the basic waveguide resonance oscillator 100 of the present invention in more detail. The basic oscillator 100 has a waveguide junction 102 with reflective delay elements 104 and 106 connected to the junctions two sides. Each delay element 104, 106 outputs its input signal with a delay of one sample period, of time duration T. The waveguide junction 102 contains four multipliers 107, 108, 109, 110 and two adders 111 and 112. Multipliers 107 and 108 multiply their respective inputs by a factor of c, while multipliers 109 and 110 multiply their respective inputs by respective factors of −s and s. The two multiplication factors s and c are defined by the following equations:

$$s=\sin(\Theta)$$

$$c=\cos(\Theta)=(1-s^2)^{1/2}$$

$$s^2+c^2=1$$

$$\Theta=2\pi f_0 T$$

where T is the sampling period (i.e., the amount of time between updates of the oscillator's nodes, as well as the delay period of the delay elements 104, 106), and $f_0$ is the oscillation frequency of the signals on nodes X and Y of the waveguide resonance oscillator 100. As will be discussed in more detail below, Θ represents the phase advance of the sinusoidal waveforms on nodes X and Y during each sampling period.

The computations required to update the X and Y signals from period n−1, at time=(n−1)T, to the next period n, at time=nT, are as follows:

$$X_n=c\cdot X_{n-1}-s\cdot Y_{n-1}$$

$$Y_n=s\cdot X_{n-1}+c\cdot Y_{n-1}$$

If X(0)=1 and Y(0)=0, and the values of s and c are unchanged over time, it can be shown that $$X_n=\cos(n\Theta)$$

$$Y_n=\sin(n\Theta)$$

In other words, the basic waveguide oscillator structure of FIG. 3 generates sinusoidal waveforms without having to perform sine-wave table look ups and interpolations every sample period.

To prevent "round-off error" from causing the X and Y signals to grow or decay in amplitude, it is essential that the waveguide oscillator either include a means of amplitude control, or have a mechanism for controlling the direction of round-off errors generated by the waveguide junction.

Figure 4:
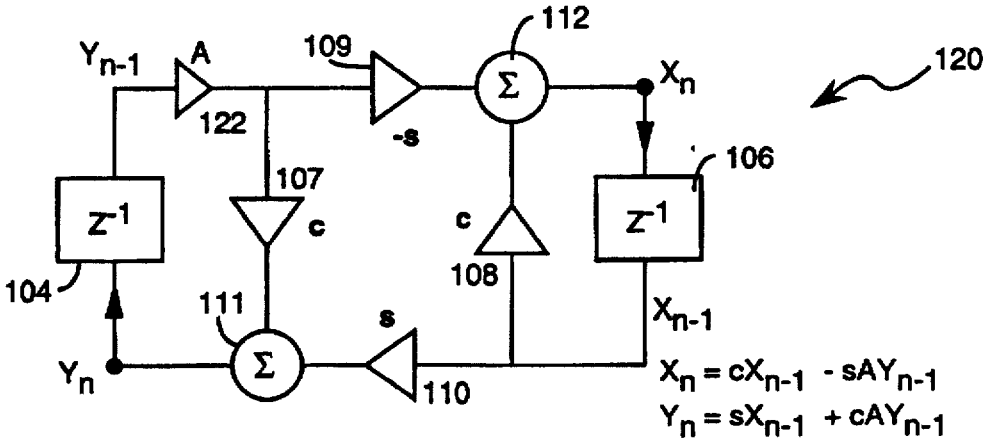
FIG. 4 is a block diagram of a modified version of a waveguide resonance oscillator which generates sinusoidal waveforms having an exponentially decaying or growing amplitude.

Referring to FIG. 4, a modified waveguide resonance oscillator 120 having one additional multiplier 122 can be used for controlling the amplitude envelope of the X and Y signals. For instance, if the amplitude A is set and held at a fixed value, the oscillator will generate exponentially growing or decaying sinusoidal waveforms (depending on whether A is greater or less than 1). The computations required to update the X and Y signals of oscillator 120 are as follows:

$$X_n=c\cdot X_{n-1}-A\cdot s\cdot Y_{n-1}$$

$$Y_n=s\cdot X_{n-1}+A\cdot c\cdot Y_{n-1}$$

If X(0)=1 and Y(0)=0, and the values of s, c and A are unchanged over time, it can be shown that $$X_n=A^n\cos(n\Theta+\Phi_{A,X,n})$$

$$Y_n=A^n\sin(n\Theta+\Phi_{A,Y,n})$$

assuming no round-off errors caused by finite precision computations. $\Phi_{A,X,N}$ and $\Phi_{A,Y,n}$ denote a slight shift in frequency when A¢≠1. For practical values of A, however, these shifts can be ignored. Note that the amplitude modulation multiplier 122 can be a "reduced precision" multiplier that multiplies its input by a factor of $1+/-2^{-N}$, which can be implemented using a shift register and adder, thereby requiring much less circuitry than a full precision multiplier.

One Multiplier Junction and Amplitude Normalization

Figure 5:
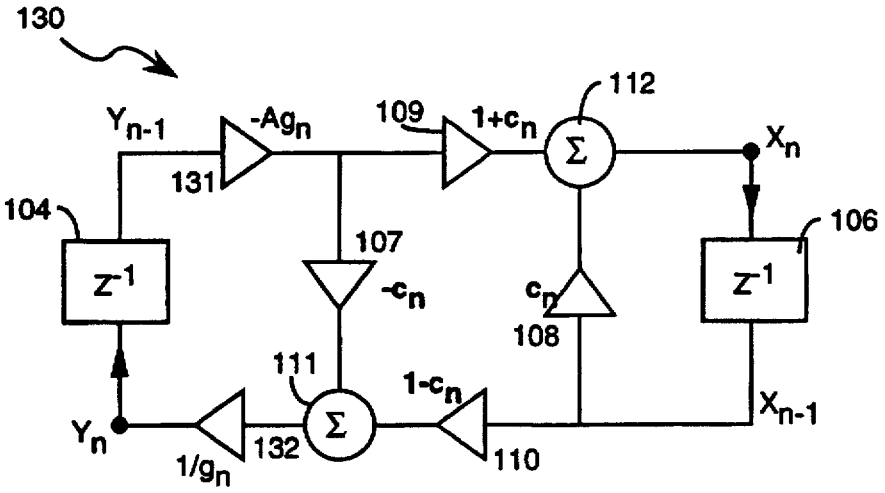
FIG. 5 is a block diagram of a converted form of the waveguide resonance oscillator of FIG. 3.
Figure 6:
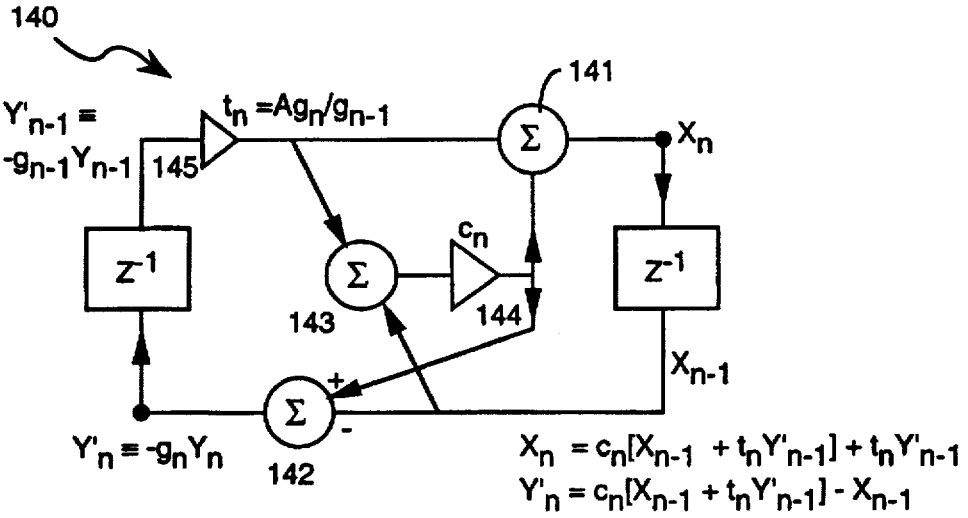
FIG. 6 is a block diagram of a computationally efficient waveguide resonance oscillator.

Referring to FIGS. 3, 5 and 6, the waveguide junction 102 of FIG. 3 can be converted to produce the waveguide oscillator 130 shown in FIG. 5, in which the multiplication factors of the multipliers 107–110 are −c, c, 1+c, and 1−c, respectively, and normalization multipliers 131 and 132 have multiplication factors of g and 1/g, where g is defined as:

$$c_n=\cos(n\Theta)$$

$$g_n=[(1-c_n)/(1+c_n)]^{0.5}$$

In other words, in the absence of round-off error, the waveguide oscillator 130 of FIG. 5 produces the same waveforms on nodes X and Y as the waveguide oscillator 100 of FIG. 3.

Next, the waveguide oscillator 130 of FIG. 5 is converted into the waveguide oscillator 140 of FIG. 6, which has just three adders 141, 142, 143 and two multipliers 144 and 145. This conversion is accomplished by combining multipliers 131 and 132 into one multiplier 145, and by combining the multipliers 107–110 into one adder 143 and one multiplier 144. The waveguide oscillator 140 of FIG. 6 is mathematically identical to that of FIGS. 3 and 5, and the oscillator 140 of FIG. 6 has the advantage that it suffers from less computational noise (associated with using finite precision mathematical multipliers) because only one multiplier 144 is used in the junction, reducing the number of rounding errors produced during each cycle of signal updating. Because the multiplier 144 affects only the frequency of the generated signals, round-off errors produced by this multiplier cannot lead to exponential growth or decay of the X and Y signals.

Note that the multiplication factor $c_n$ used by multiplier 144 is subscripted with time index n to indicate that the multiplier coefficient can be changed each sample period. The second multiplier 145, herein called the amplitude control multiplier, can be used for amplitude normalization (as described here) and also for amplitude envelope generation. The normalization multiplication factor $t_n$ shown next to multiplier 145 is equal to $g_n/g_{n-1}$. Furthermore, when the frequency control coefficient $c_n$ remains unchanged from period n−1 to period n, the normalization multiplication factor $t_n$, is identically equal to 1, thereby eliminating the need for the second multiplication altogether (where constant amplitude is desired).

To prevent long-term drift in the output signal's amplitude due to round-off error in the $t_n$ coefficient, "controlled rounding" can be used at a slow update rate. For this purpose, the amplitude $X^2+Y^2$ can be computed and compared to the desired amplitude. Then the direction of rounding by the $t_n$ amplitude normalization multiplier 145 can be adjusted so as to increase signal amplitude, by adding 1 to the least significant bit (LSB) of the multiplier's output when it is positive and subtracting an LSB when the output is negative; controlled rounding can decrease the signal amplitude by doing the opposite. An alternative to adding or subtracting an LSB is simply to "OR" in a "1" with the LSB or set the LSB to zero, respectively.

A similar amplitude modulation scheme, using step sizes typically larger than the LSB, can be used to follow any desired amplitude envelope automatically, so long as the rate of amplitude modulation is reasonably slow.

Figure 7:
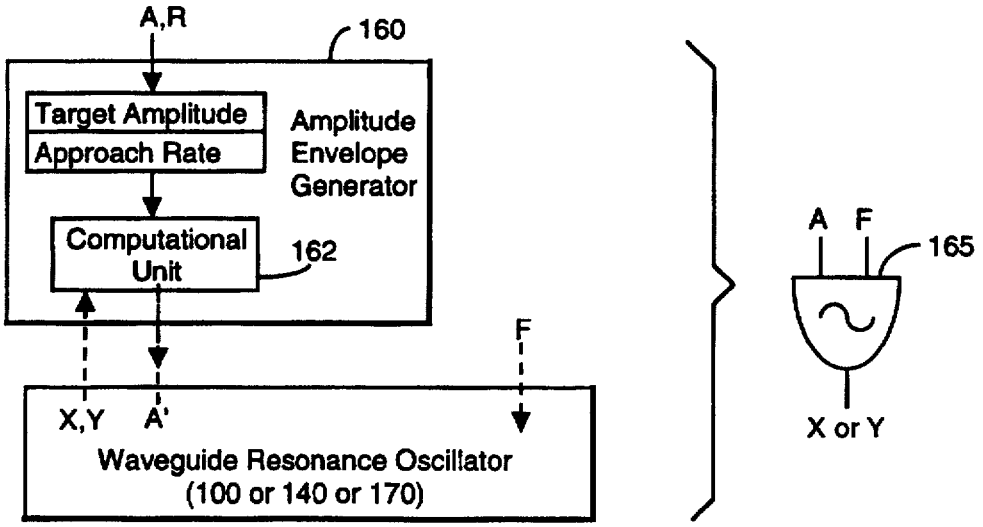
FIG. 7 is a block diagram of a waveguide resonance oscillator with an amplitude envelope generator.

A general circuit architecture for amplitude control is shown in FIG. 7, in which the amplitude multiplier coefficient used by a waveguide resonance oscillator (i.e., any of the waveguide resonance oscillator circuits of the present invention) is controlled by an amplitude envelope generator 160. Ideally, the amplitude envelope generator 160 will have a computational unit 162 that both monitors the current amplitude of the X, Y signals output by the waveguide resonance oscillator and generates a multiplier coefficient A' that will ramp the amplitude of X, Y to a specified target amplitude at an a specified approach rate. Envelope generators which perform similar functions, for use with other types of music synthesizers and waveform synthesizers, are known to those skilled in the art. However, due to the closed loop form of the waveguide resonance oscillator circuits of the present invention, this envelope generator 160 controls the amplitude envelope by generating a coefficient A that increases or decreases the current amplitude of the oscillator signals by a specified factor. As a result, the amplitude envelope is substantially piecewise exponential.

The combination of a waveguide resonance oscillator circuit and envelope generator 160 will herein be called a "unit generator" 165 and depicted using the shown in FIG. 7, where the "A" is the amplitude control input and the "F" input is the frequency control input.

It should be noted that in the absence of round-off error the waveguide resonance oscillator 100 of FIG. 3 does not require any "amplitude correction", even when its frequency control coefficient $c_n$ is being modulated, because it is in normalized form. As a result, it may be preferable to use the waveguide resonance oscillator 100 of FIG. 3 in some circumstances, such as when using a waveguide resonance oscillator to produce frequency modulated signals. The waveguide resonance oscillator 100 of FIG. 3 is also preferred for generating very low frequency-sinusoids because the $t_n$ multiplier coefficient in oscillators 140 and 170 can become very large as Θ approaches zero.

Figure 8:
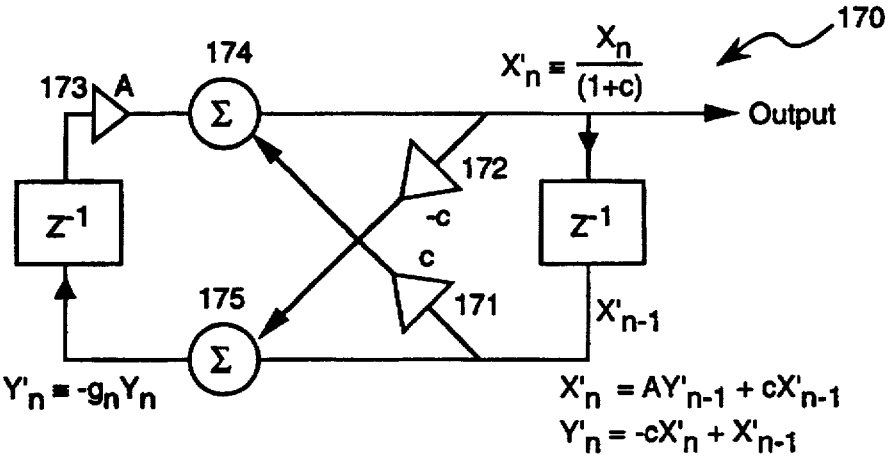
FIG. 8 shows an alternate form of the oscillator of FIG. 6.

Referring to FIG. 8, an alternate form of waveguide resonance oscillator 140 is an oscillator 170 with three multipliers 171–173 and two adders 174, 175 (instead of two multipliers and three adders). The update equations are shown in FIG. 8. In the case of constant amplitude, constant frequency sinusoid generation, only two multipliers are active.

FM Waveform Synthesis

Next, we consider several methods of using the waveguide resonance oscillators of the present invention to generate frequency modulated waveforms. One method of modulating the frequency of the waveguide resonance oscillator 100 of FIG. 3 by a modulating factor Δk is to change the multiplier coefficients once each sample period as follows:

$$s_n=s_{n-1}+C_{n-1}\cdot\Delta k$$

$$c_n=c_{n-1}-s_{n-1}\cdot\Delta k$$

where the absolute value of Δk is much less than 1. Alternately, the multiplier coefficients can modulated in accordance with:

$$s_n=s_{n-1}+\mathrm{sign}(c_{n-1})\cdot\Delta k$$

$$c_n=c_{n-1}-\mathrm{sign}(s_{n-1})\cdot\Delta k$$

where sign(x)=1 if x≧0, and sign(x)=−1 if $x<0_1$.

Figure 9:
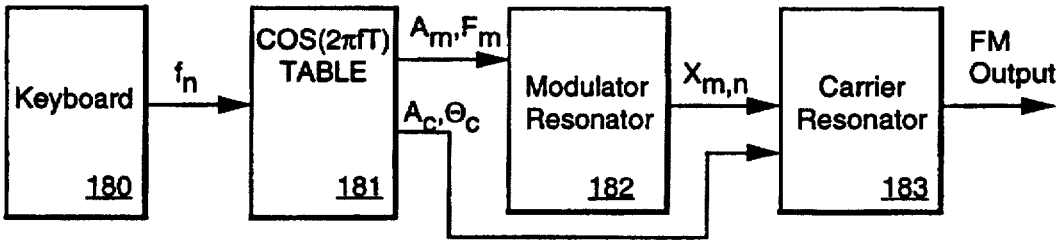
FIG. 9 is a conceptual diagram of a musical synthesizer using frequency modulation signal synthesis.

Referring to FIG. 9, a second model for performing FM waveform synthesis uses two waveguide resonance modulators. A control value, such as a frequency value $f_n$, such as might be obtained from an electronic keyboard 180, is converted into a resonance control value by looking up a corresponding value $c_n$ in a cosine-wave table 181, and then a first waveguide oscillator 182 (called the modulation resonator) is run using that value as its multiplier value. The output signal $X_{m,n}$ from the modulation resonator 182 is used to modify the multiplier value of a second waveguide oscillator 183, called the carrier resonator. The output of the carrier resonator 183 is a frequency modulated waveform. To create a corresponding FM acoustic signal, the output of the carrier resonator 183 would be supplied, in sequence, to a digital-to-analog converter and then an audio speaker.

Figure 10:
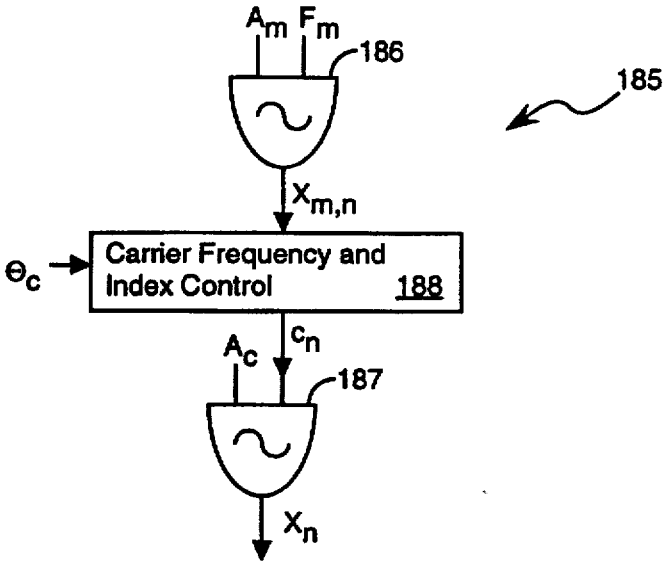
FIG. 10 is a block diagram of an FM signal synthesizer using two waveguide resonance oscillators.

It should be noted that while the FM synthesis system of FIG. 10 uses a cosine-wave table 181, that table is typically used only occasionally, when the control parameters from the keyboard change, and is not used every sample to generate the output waveform. As a result, computation of interpolated cos( ) values does not impose a significant computational burden on the synthesizer.

FIG. 10 shows one possible implementation of an FM signal synthesizer 185 having a modulation waveguide oscillator 186 whose output $X_{m,n}$ is mixed with a carrier frequency value $\Theta_c$ to produce a frequency control parameter $c_n$ for a carrier waveguide oscillator 187. The amplitude of the modulation waveguide oscillator's output signal relative to the magnitude of the carrier frequency value $\Theta_c$ is can be called the FM index.

Figure 11A:
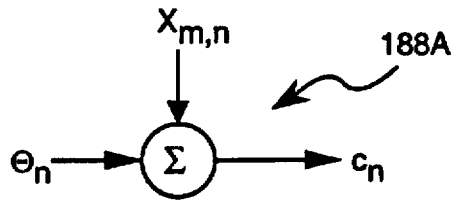
FIGS. 11A, 11B and 11C show alternate computational circuits for interconnecting the two waveguide resonance oscillators in the FM signal synthesizer of FIG. 10.
Figure 11B:
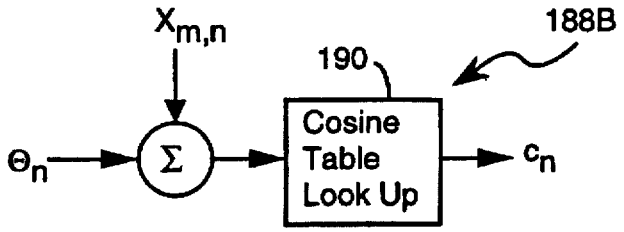

As shown in FIGS. 10, 11A–11C, there are several different ways that circuit 188 can be implemented to combine the output of the modulation waveguide oscillator 186 with the carrier frequency parameter $\Theta_c$ to produce a frequency control parameter $c_n$ for the carrier waveguide oscillator 187. In FIG. 11A, the circuit 188A simply adds the two signals: $c_n=X_{m,n}+\Theta_c$. In FIG. 11B, after adding the two signals, circuit 188B uses a cosine table look up 190: $c_n=\cos(X_{m,n}+\Theta_c)$. This implementation has the obvious disadvantages of requiring the storage of a cosine table and the computational burden of a table look up once every sample period.

Figure 11C:
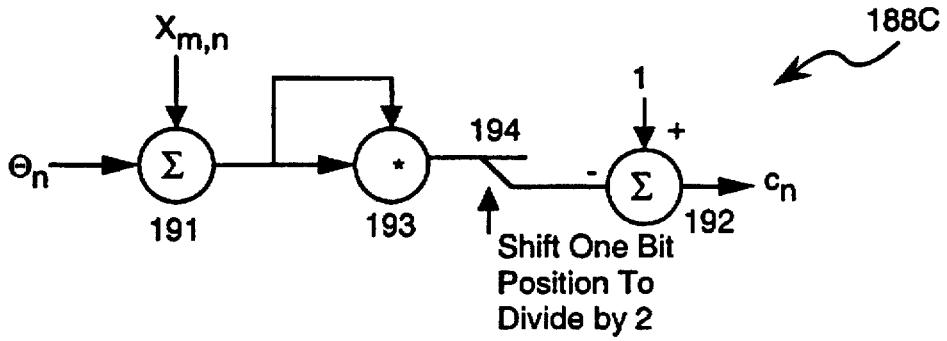

The circuit 188C in FIG. 11C uses just two adders 191, 192 and one multiplier 193 to produce $c_n=1-0.5\cdot(X_{m,n}+\Theta_c)^2$, which is a good approximation of $\cos(X_{m,n}+\Theta_c)$ when $X_{m,n}+\Theta_c<0.5$. Note that the divide by two operation in circuit 188C is accomplished by simply discarding the low order bit of the multiplier's output, thereby shifting the multiplier output one bit position.

As will be understood by those skilled in the art, a large number of alternate circuits could be used to combine the output of the modulation waveguide oscillator 186 with the carrier frequency parameter $\Theta_c$ to produce a frequency control parameter $c_n$ for the carrier waveguide oscillator 187.

Additive Synthesis

Figure 12:
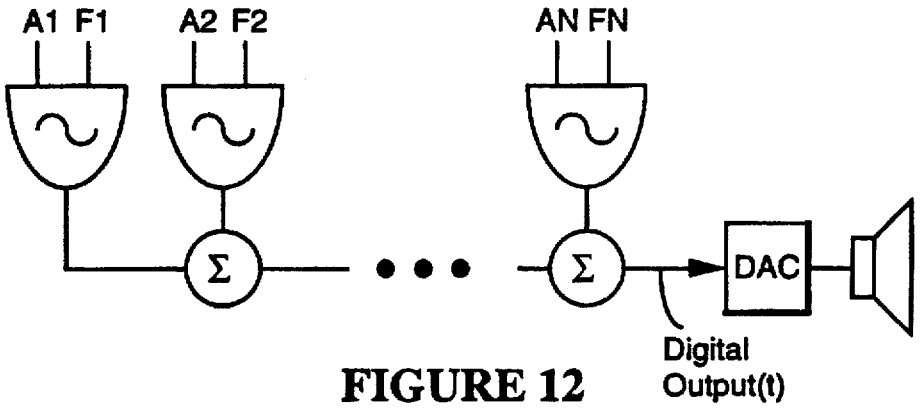
FIG. 12 is a block diagram of a sound synthesizer using additive synthesis of synthesized sinusoidal waveforms.

FIG. 12 shows an example of additive synthesis using multiple parallel oscillators and a set of signal summers. The summed signal is then converted by a digital-to-analog signal converter and a speaker.

Figure 13:
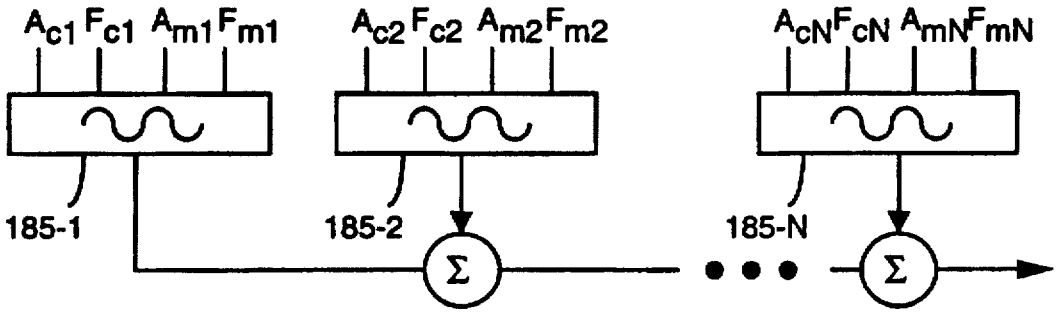
FIG. 13 is a block diagram of a sound synthesizer using additive synthesis of synthesized FM waveforms.

FIG. 13 shows an example of FM additive synthesis using multiple parallel FM signal synthesizers 185 of the type shown in FIG. 10, and a set of signal summers. In some cases, such as in piano synthesis, a combination of elements from FIGS. 12 and 13 is very effective.

Figure 14:
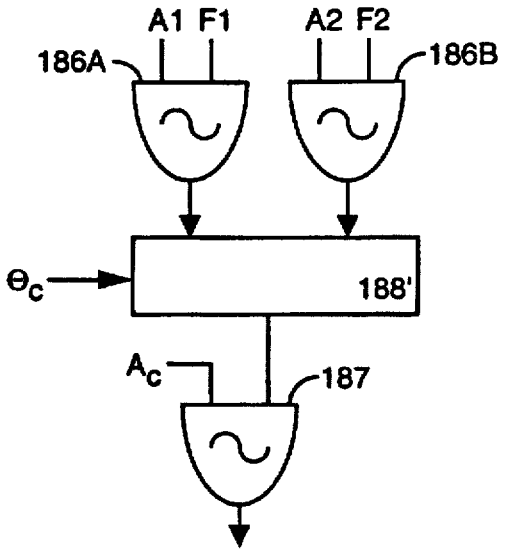
FIG. 14 is a block diagram of an FM signal synthesizer using two modulation oscillators and a carrier oscillator.

FIG. 14 shows an example of FM signal synthesis in which two (or more) modulator waveguide resonance oscillators 186A, 186B are used to modulate a carrier frequency parameter used by a carrier waveguide resonance oscillator 187. Typically, the modulator outputs are added together in 188', but other combinations can be useful, such as multiplication of the two modulator outputs.

Figure 15:
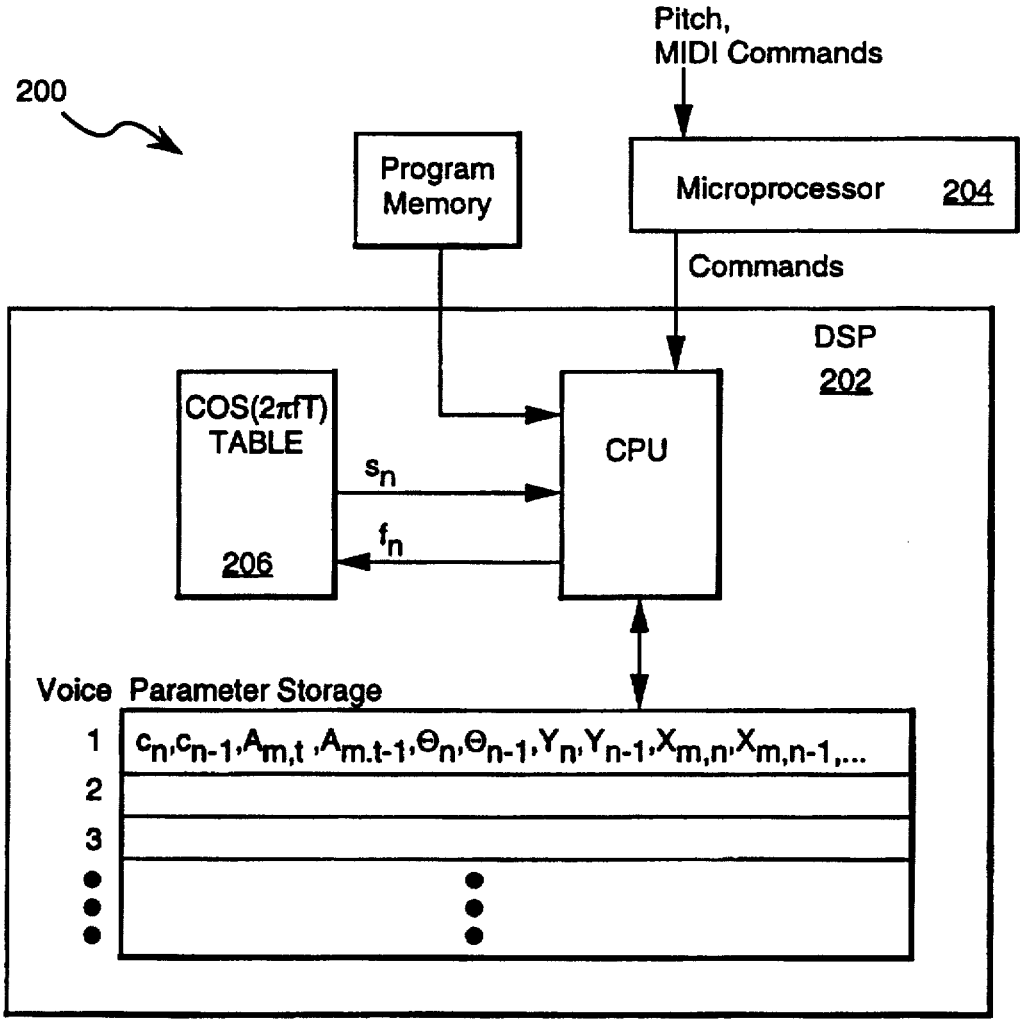
FIG. 15 is a block diagram of a synthesizer having multiple two-oscillator FM signal synthesizers implemented using a single high-speed digital signal processor.

FIG. 15 shows a multi-signal synthesizer 200 having multiple FM signal synthesizers implemented using a single high-speed digital signal processor (DSP) 202. Commands and control values are sent to the DSP 202 by a microprocessor 204 or other system (e.g., a MIDI device connected to a keyboard). Either the microprocessor 204 or the DSP 202 converts modulation frequency values into waveguide oscillator multiplier values $c_{m,n}$ using a cosine-wave table 206. The DSP's internal memory 208 is used to store an array of parameters representing the current state of each of several FM signal synthesizers.

The number of FM signals that one DSP 202 can generate is a function of the sample period, the DSP's instruction computation rate, and the number of computation cycles required for each FM signal. For instance, if the output signal's sample rate is 44.1 kilohertz, the DSP 202 runs at a rate of 20 million instructions per second, and updating each voice requires 20 instructions, then the one DSP 202 will be able to generate 21 or 22 FM signals, depending on the amount of instruction cycles that need to be reserved for receiving commands and other overhead tasks.

Figure 16:
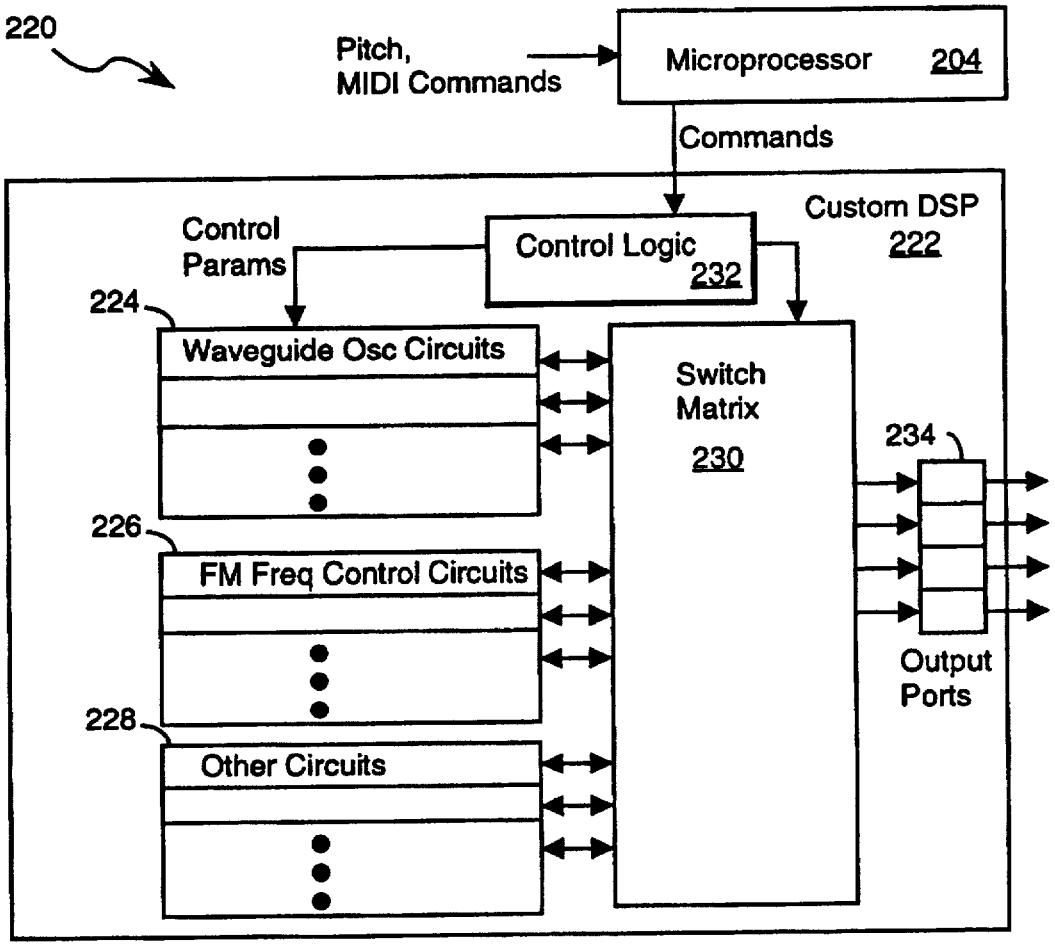
FIG. 16 is a block diagram of a customized digital signal processor for signal synthesis using waveguide resonance oscillators.

FIG. 16 shows another system 220 for simultaneously synthesizing multiple sinusoidal waveforms. This system uses a customized DSP 222 having an array 224 of waveguide resonance oscillator circuits, an array 226 of FM frequency control circuits (such as circuit 188, described above), and an array 228 of other circuits, such as adders (e.g., for additive synthesis), multipliers, and the like. A switch matrix 230 interconnects the inputs and outputs of these circuits in any specified way, thereby allowing a great degree of freedom in the implementation of signal synthesizers. Control logic 232 sends control parameters to the circuits 224, 226, 228, and also instructs the switch matrix 230 on the connections to be formed. The switch matrix also connects specified synthesized signals to output ports 234. The customized DSP 222 is suitable for VLSI implementation.

Figure 17:
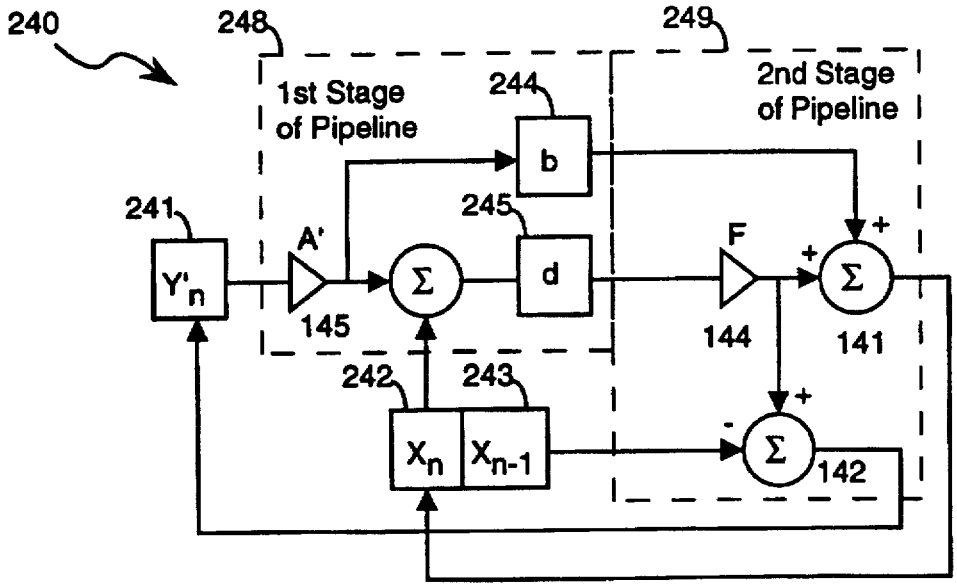
FIG. 17 depicts a two stage pipeline circuit for efficiently implementing the waveguide resonance oscillator of FIG. 6.

FIG. 17 shows a pipelined waveguide resonance oscillator circuit 240 that implements the oscillator circuit 140 of FIG. 6. This circuit 240 could be used in the DSP 222 of FIG. 16 to implement some, if not all, of the waveguide oscillator circuits in array 224. It may be desirable to have two or more different types of waveguide resonance oscillator circuits (100, 140 or 170) in the DSP 222, despite the increased cost of using other oscillator circuits with more multipliers, because each has slightly different computational characteristics.

Note that $Y'_n$, in FIG. 17 is equivalent to $-g_nY_n$. Five pipeline registers 241–245 are used to store computed values at the end of each clock cycle. Thus, the Y' value computed during each clock cycle is stored in register 241 and is then used during the next clock cycle as the $Y'_{n-1}$ value. In the first pipeline stage 248, the multiplier 145 outputs its computed value "b" before the end of the clock cycle so that the $X_n$ value can be added to "b" to generate "d" in a single clock cycle. Similarly, in the second pipeline stage 249, the multiplier 144 outputs its computed value before the end of the clock cycle so that the computed value can combined, by adders 141, 142, with the delayed X value and with "b". Registers 242 and 243 are used as a two-stage shift register, with the value in register 242 being transferred to register 243 at the end of each clock cycle. Two registers are needed for the X value because the same X value must be used in both stages of the pipelined circuit. Both pipeline stages execute in parallel, which each stage working on a different signal sample.

If the computational elements of the circuit 240 are much faster than what is needed for a single synthesized signal, use of the circuit can be time multiplexed. Each of the registers 241–245 is made into a vector register holding values for M different signals, and the circuit 240 is run M times during each sample period to process each of the M signals.

The circuit 240 is computationally efficient because every computational element (i.e., every adder and multiplier) is used during every clock cycle. As will be appreciated by those skilled in the art, other pipeline line circuit structures could be used in place of the one shown in FIG. 17. For instance, a four stage pipeline circuit could be used.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A waveguide resonance oscillator for generating sampled sinusoidal waveforms, comprising:

two digital delay elements coupled to a digital waveguide junction, said two digital delay elements having distinct respective input and output nodes and means for receiving respective first and second signals on their respective input nodes and for outputting said respective received signals on their respective output nodes after a delay of one sample period of predefined duration, said waveguide junction including a plurality of digital signal adders and a first digital signal multiplier interconnected so as to compute, once each sample period, new values for said first and second signals as a function of the two signals output by said two digital delay elements; said first and second signals each having an associated amplitude, said first and second signals having a same frequency of oscillation;

said first digital signal multiplier multiplying an output of one of said plurality of digital signal adders by a coefficient value, wherein said first and second signals' frequency of oscillation is determined solely by said coefficient value and said predefined sample period duration;

an amplitude monitor for monitoring said amplitudes associated with said first and second signals and for generating an amplitude envelope control coefficient corresponding to a differential, if any, between at least one of said monitored amplitudes and a specified amplitude; and a second digital signal multiplier for multiplying a preselected one of the respective input and output signals of said two digital delay elements by said amplitude envelope control coefficient so as to generate said first and second signals with an envelope amplitude corresponding to said specified amplitude;

wherein said first and second signals are sampled sinusoidal waveforms that are 90 degrees out of phase with each other.

2. The waveguide resonance oscillator of claim 1, wherein when said coefficient value is time varying, said first and second signals comprise sampled sinusoidal waveforms of time varying frequency.

3. The waveguide resonance oscillator of claim 2, said second digital signal multiplier for multiplying one of the respective signals output by said two digital delay elements by a coefficient so as to maintain said sampled sinusoidal waveform at a substantially constant amplitude when said specified amplitude is substantially constant.

4. An acoustic sound synthesizer, comprising:

first and second interconnected waveguide resonance oscillators for generating first and second sampled sinusoidal waveforms; wherein each of said first and second waveguide resonance oscillators is a distinct closed-loop oscillator;

each said waveguide resonance oscillator including two digital delay elements coupled to a digital waveguide junction, said two digital delay elements having distinct respective input nodes that receive respective first and second signals and output nodes for outputting said respective received signals after a delay of one sample period of predefined duration, said waveguide junction including a plurality of digital signal adders and a digital signal multiplier interconnected so as to compute, once each sample period, new values for said first and second signals as a function of the two signals output by said two digital delay elements; wherein said digital signal multiplier multiplies a signal value, generated by one of said plurality of digital signal adders, by a coefficient value that determines said first and second signals' frequency of oscillation;

said first waveguide resonance oscillator outputting one of said first and second signals as said first sampled sinusoidal waveform;

said second waveguide resonance oscillator including a coefficient modulation element that modulates its coefficient value with said first sampled sinusoidal waveform, so that said second sampled sinusoidal waveform generated by said second waveguide resonance oscillator is frequency modulated in accordance with said first sampled sinusoidal waveform;

said second waveguide resonance oscillator's coefficient modulation element having an input port for receiving said first sampled sinusoidal waveform; and wherein said second waveguide resonance oscillator is coupled to said first waveguide resonance oscillator only through said input port of said second waveguide resonance oscillator's coefficient modulation element.

5. The acoustic sound synthesizer of claim 4, said waveguide junction in said first waveguide resonance oscillator further including a second digital signal multiplier for multiplying a preselected one of the respective input and output signals of said two digital delay elements by an amplitude envelope control coefficient so as to generate said first and second signals with a specified amplitude envelope, said amplitude envelope controlling said second waveguide resonance oscillator's index of frequency modulation.

6. A method for generating a sampled sinusoidal waveform, in a waveguide resonance oscillator having first and second digital delay elements coupled to a digital waveguide junction, comprising the steps of:

receiving a first signal on the input node of said first digital delay element and receiving a second signal on the input node of said second digital delay element; said first and second signals each having an associated amplitude, said first and second signals having a same frequency of oscillation;

outputting the respective received signals on their respective output nodes after a delay of one sample period of predefined duration;

computing, once each sample period, new values for the first and second signals as a function of the two signals output by said two digital delay elements, wherein said computing step includes multiplying an output of one of said plurality of digital signal adders by a coefficient value, wherein said first and second signal's frequency of oscillation is determined solely by said coefficient value and said predefined sample period duration;

generating new first and second signals as sampled sinusoidal waveforms that are 90 degrees out of phase with each other;

monitoring said amplitudes associated with said first and second signals and generating an amplitude envelope control coefficient corresponding to a differential, if any, between at least one of said monitored amplitudes and a specified amplitude; and multiplying a preselected one of the respective input and output signals of said two digital delay elements by said amplitude envelope control coefficient so as to generate said first and second signals with an envelope amplitude corresponding to said specified amplitude.

7. The method for generating a sampled sinusoidal waveform of claim 6, wherein:

said multiplying step includes multiplying by a time varying coefficient; and said generating step includes generating the new first and second signals as sampled sinusoidal waveforms of time varying frequency.

8. The method for generating a sampled sinusoidal waveform of claim 7, wherein:

said multiplying step includes maintaining the sampled sinusoidal waveform at a substantially constant amplitude when said specified amplitude is substantially constant.

9. A method for synthesizing an acoustic sound, in an acoustic synthesizer having first and second interconnected waveguide resonance oscillators where each of said waveguide oscillators includes two digital delay elements coupled to a digital waveguide junction, comprising the steps of:

generating first and second sampled sinusoidal waveforms by said first and second interconnected waveguide resonance oscillators; wherein each of said first and second waveguide resonance oscillators is a distinct closed-loop oscillator;

receiving the first signal on the input node of said first digital delay elements and receiving the second signal on the input node of said second digital delay elements;

outputting the respective received signals on their respective output nodes after a delay of one sample period of predefined duration;

computing, once each sample period, new values for the first and second signals as a function of the two signal's output from said two digital delay elements, wherein said computing step includes multiplying a signal value, generated by one of a plurality of digital signal adders, by a coefficient value that determines the first and second signal's frequency of oscillation;

generating, in said first waveguide resonance oscillator, one of the first and second signals as the first sampled sinusoidal waveform;

generating, in said second waveguide resonance oscillator, a second one of the first and second signals as the second sampled sinusoidal waveform, wherein said step of generating the second sampled sinusoidal waveform includes modulating its coefficient value with the first sampled sinusoidal waveform, so that the second sampled sinusoidal waveform is frequency modulated in accordance with the first sampled sinusoidal waveform;

said second waveguide resonance oscillator's coefficient modulation element having an input port for receiving said first sampled sinusoidal waveform; and wherein said second waveguide resonance oscillator is coupled to said first waveguide resonance oscillator only through modulation of said second waveguide resonance oscillator's coefficient value by said first sampled sinusoidal waveform.

10. The method for synthesizing an acoustic sound of claim 9, wherein:

said computing step further includes multiplying a preselected one of the respective input and output signals of said two digital delay elements by an amplitude envelope control coefficient; and said step of generating the first sampled sinusoidal waveform includes generating the first signal with a specified amplitude envelope; and said step of generating the second sampled sinusoidal waveform includes generating the second signal with a specified amplitude envelope; and said step of generating the second sampled sinusoidal waveform includes controlling said second waveguide resonance oscillator's index of frequency modulation in accordance with the amplitude envelope.

11. A closed-loop waveguide resonance oscillator for generating sampled sinusoidal waveforms, comprising:

two digital delay elements coupled to a digital waveguide junction, said two digital delay elements having distinct respective input and output nodes and means for receiving respective first and second signals on their respective input nodes and for outputting said respective received signals on their respective output nodes after a delay of one sample period of predefined duration, said waveguide junction including a plurality of digital signal adders and a single digital signal multiplier interconnected so as to compute, once each sample period, new values for said first and second signals as a function of the two signals output by said two digital delay elements; said first and second signals having identical associated amplitudes and a same frequency of oscillation;

said single digital signal multiplier multiplying an output of one of said plurality of digital signal adders by a coefficient value, wherein said first and second signals' frequency of oscillation is determined solely by said coefficient value and said predefined sample period duration;

wherein:

said single digital signal multiplier is the only multiplier used to maintain said first and second signals' frequency of oscillation; and said first and second signals are sampled sinusoidal waveforms that are 90 degrees out of phase with each other.

12. The closed-loop waveguide resonance oscillator of claim 11; said waveguide resonance oscillator including;

an amplitude monitor for monitoring said amplitudes associated with said first and second signals and for generating an amplitude envelope control coefficient corresponding to a differential, if any, between at least one of said monitored amplitudes and a specified amplitude; and a second digital signal multiplier for multiplying a preselected one of the respective input and output signals of said two digital delay elements by said amplitude envelope control coefficient so as to generate said first and second signals with an envelope amplitude corresponding to said specified amplitude.

* * * * *